US006190001B1

(12) United States Patent
Saruta

(10) Patent No.: US 6,190,001 B1
(45) **Date of Patent: *Feb. 20, 2001**

(54) DOT PRINTING WITH PARTIAL DOUBLE SCANNING OF RASTER LINES

(75) Inventor: Toshihisa Saruta, Nagano-ken (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/069,753

(22) Filed: Apr. 30, 1998

(30) Foreign Application Priority Data

May 7, 1997 (JP) ..... 9-117330
Apr. 17, 1998 (JP) ..... 10-124186

(51) Int. Cl.[7] ..... B41J 2/145
(52) U.S. Cl. ..... 347/41
(58) Field of Search ..... 347/41, 9, 10, 347/42, 43

(56) References Cited

U.S. PATENT DOCUMENTS 4,198,642 4/1980 Gamblin .
5,070,345 12/1991 Lahut et al. ..... 347/41
5,359,355 * 10/1994 Nagoshi et al. ..... 347/9
5,614,931 * 3/1997 Koike et al. ..... 347/43
5,708,463 * 1/1998 Hirabayashi et al. ..... 347/43

FOREIGN PATENT DOCUMENTS 0 679 518 11/1995 (EP) .
0 730 973 9/1996 (EP) .
0 744 706 11/1996 (EP) .
0 751 476 1/1997 (EP) .
6-35191 5/1994 (JP) .

* cited by examiner

*Primary Examiner*—N. Le
*Assistant Examiner*—Heam Yuth
(74) *Attorney, Agent, or Firm*—Oblon, Spivak, McClelland, Maier & Neustadt, P.C.

(57) ABSTRACT

The sub-scan feed is carried out by a fixed amount of F dots. When is set equal to k dots (where k is an integer of not less than 3), a number of used nozzles N in the course of one main scan (where N is an integer of not less than 3) and parameters Na, Nb, Nb, m, and L satisfy Equations: (1)–(4), (1) N=Na+Nb, (2) Na=m×k±1, (3) Nb=Rd(L×Na÷k), (4) F=Na, where Na is the number of basic nozzels, Nb is the number of additional nozzels, m is an integer of not less than 1, L is an integer satisfying a relation of 1≦L<k, and an operator Rd( ) denotes an operation of rounding a decimal fraction in parentheses.

9 Claims, 15 Drawing Sheets

FIRST EMBODIMENT

Fig. 3(A) ARRANGEMENT OF NOZZLE ARRAYS
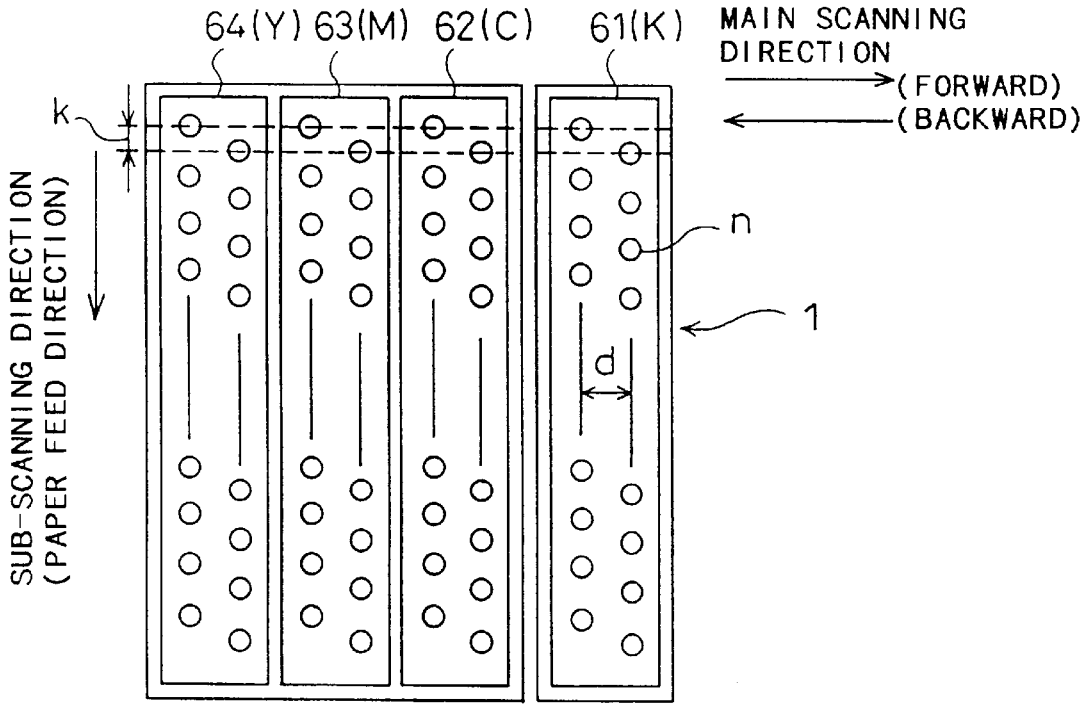
Fig. 3(B) DOTS FORMED BY ONE NOZZLE ARRAY
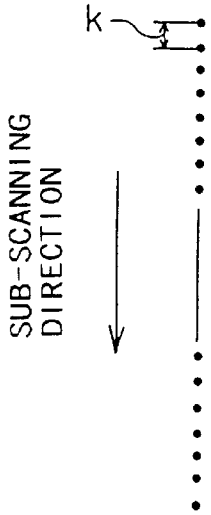

FIRST EMBODIMENT

Fig. 5

RASTER LINE NUMBERS SUBJECT TO RECORDING BY RESPECTIVE NOZZLES

| Nozzle No. | pass 1 | pass 2 | pass 3 | pass 4 | pass 5 |
|---|---|---|---|---|---|
| #1 | n/a | n/a | n/a | n/a | 3 |
| #2 | n/a | n/a | n/a | n/a | 7 |
| #3 | n/a | n/a | n/a | n/a | 11 |
| #4 | n/a | n/a | n/a | 4 | 15 |
| #5 | n/a | n/a | n/a | 8 | 19 |
| #6 | n/a | n/a | 1 | 12 | 23 |
| #7 | n/a | n/a | 5 | 16 | 27 |
| #8 | n/a | n/a | 9 | 20 | 31 |
| #9 | n/a | 2 | 13 | 24 | 35 |
| #10 | n/a | 6 | 17 | 28 | 39 |
| #11 | n/a | 10 | 21 | 32 | 43 |
| #12 | 3 | 14 | 25 | 36 | 47 |
| #13 | 7 | 18 | 29 | 40 | 51 |
| #14 | 11 | 22 | 33 | 44 | 55 |

n/a : transfer of 0 data (non-record data)

Fig. 6

PRINT DATA ALLOCATIN IN FIRST EMBODIMENT

| Pass | Pixel Position in Raster Direction | 1 | 2 | 3 | 4 | 5 | 6 | 7 |
|---|---|---|---|---|---|---|---|---|
| — | Print data for third raster line | 1 | 1 | 1 | 0 | 0 | 1 | 1 |
| pass 5 | Print data for nozzle #1 | 1 | 0 | 1 | 0 | 0 | 0 | 1 |
| pass 1 | Print data for nozzle #12 | 0 | 1 | 0 | 0 | 0 | 1 | 0 |
| — | Print data for seventh raster line | 1 | 1 | 1 | 1 | 1 | 1 | 1 |
| pass 5 | Print data for nozzle #2 | 1 | 0 | 1 | 0 | 1 | 0 | 1 |
| pass 1 | Print data for nozzle #13 | 0 | 1 | 0 | 1 | 0 | 1 | 0 |
| — | Print data for eleventh raster line | 1 | 0 | 1 | 0 | 0 | 1 | 0 |
| pass 5 | Print data for nozzle #3 | 1 | 0 | 1 | 0 | 0 | 0 | 0 |
| pass 1 | Print data for nozzle #14 | 0 | 0 | 0 | 0 | 0 | 1 | 0 |

1 : record
0 : non-record

Fig. 7

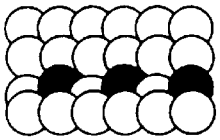

← Banding is inconspicuous.

Fig. 8

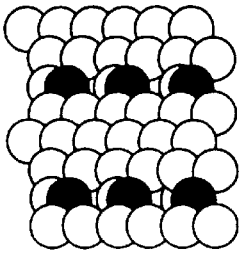

← No density difference even when starting position is shifted
← Density difference occurs when starting position is shifted
← No density difference even when starting position is shifted
← Density difference occurs when starting position is shifted ○ Dots recorded by basic nozzles
● Dots recorded by additional nozzles

Fig. 9

SPATIAL FREQUENCY AND NUMBER OF DISCRIMINATE TONES

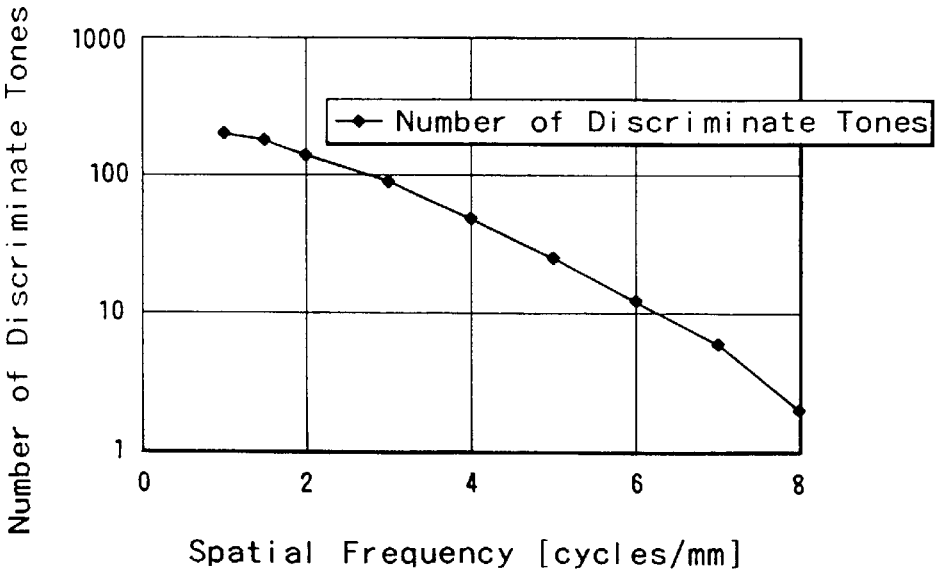

SECOND EMBODIMENT

Fig. 11

PRINT DATA ALLOCATIN IN SECOND EMBODIMENT

| Pass | Pixel Position in Raster Direction | 1 | 2 | 3 | 4 | 5 | 6 | 7 |
|---|---|---|---|---|---|---|---|---|
| — | Print data for third raster line | 1 | 1 | 1 | 0 | 0 | 1 | 1 |
| pass 5 | Print data for nozzle #1 | 1 | 1 | 1 | 0 | 0 | 1 | 1 |
| pass 1 | Print data for nozzle #12 | 1 | 1 | 1 | 0 | 0 | 1 | 1 |
| — | Print data for seventh raster line | 1 | 1 | 1 | 1 | 1 | 1 | 1 |
| pass 5 | Print data for nozzle #2 | 1 | 1 | 1 | 1 | 1 | 1 | 1 |
| pass 1 | Print data for nozzle #13 | 1 | 1 | 1 | 1 | 1 | 1 | 1 |
| — | Print data for eleventh raster line | 1 | 0 | 1 | 0 | 0 | 1 | 0 |
| pass 5 | Print data for nozzle #3 | 1 | 0 | 1 | 0 | 0 | 1 | 0 |
| pass 1 | Print data for nozzle #14 | 1 | 0 | 1 | 0 | 0 | 1 | 0 |

1 : record
0 : non-record

Fig. 12(A)
Possible combinations for k=4 and L=1

| k | m | Na | L | Nb | N |
|---|---|---|---|---|---|
| 4 | 1 | 3 | 1 | 1 | 4 |
| 4 | 1 | 5 | 1 | 2 | 7 |
| 4 | 2 | 7 | 1 | 2 | 9 |
| 4 | 2 | 9 | 1 | 3 | 12 |
| 4 | 3 | 11 | 1 | 3 | 14 |
| 4 | 3 | 13 | 1 | 4 | 17 |
| 4 | 4 | 15 | 1 | 4 | 19 |
| 4 | 4 | 17 | 1 | 5 | 22 |
| 4 | 5 | 19 | 1 | 5 | 24 |
| 4 | 5 | 21 | 1 | 6 | 27 |
| 4 | 6 | 23 | 1 | 6 | 29 |
| 4 | 6 | 25 | 1 | 7 | 32 |
| 4 | 7 | 27 | 1 | 7 | 34 |
| 4 | 7 | 29 | 1 | 8 | 37 |
| 4 | 8 | 31 | 1 | 8 | 39 |
| 4 | 8 | 33 | 1 | 9 | 42 |
| 4 | 9 | 35 | 1 | 9 | 44 |
| 4 | 9 | 37 | 1 | 10 | 47 |
| 4 | 10 | 39 | 1 | 10 | 49 |
| 4 | 10 | 41 | 1 | 11 | 52 |
| 4 | 11 | 43 | 1 | 11 | 54 |
| 4 | 11 | 45 | 1 | 12 | 57 |
| 4 | 12 | 47 | 1 | 12 | 59 |
| 4 | 12 | 49 | 1 | 13 | 62 |
| 4 | 13 | 51 | 1 | 13 | 64 |
| 4 | 13 | 53 | 1 | 14 | 67 |

Fig. 12(B)
Possible combinations for k=4 and L=2

| k | m | Na | L | Nb | N |
|---|---|---|---|---|---|
| 4 | 1 | 3 | 2 | 2 | 5 |
| 4 | 1 | 5 | 2 | 3 | 8 |
| 4 | 2 | 7 | 2 | 4 | 11 |
| 4 | 2 | 9 | 2 | 5 | 14 |
| 4 | 3 | 11 | 2 | 6 | 17 |
| 4 | 3 | 13 | 2 | 7 | 20 |
| 4 | 4 | 15 | 2 | 8 | 23 |
| 4 | 4 | 17 | 2 | 9 | 26 |
| 4 | 5 | 19 | 2 | 10 | 29 |
| 4 | 5 | 21 | 2 | 11 | 32 |
| 4 | 6 | 23 | 2 | 12 | 35 |
| 4 | 6 | 25 | 2 | 13 | 38 |
| 4 | 7 | 27 | 2 | 14 | 41 |
| 4 | 7 | 29 | 2 | 15 | 44 |
| 4 | 8 | 31 | 2 | 16 | 47 |
| 4 | 8 | 33 | 2 | 17 | 50 |
| 4 | 9 | 35 | 2 | 18 | 53 |
| 4 | 9 | 37 | 2 | 19 | 56 |
| 4 | 10 | 39 | 2 | 20 | 59 |
| 4 | 10 | 41 | 2 | 21 | 62 |
| 4 | 11 | 43 | 2 | 22 | 65 |
| 4 | 11 | 45 | 2 | 23 | 68 |
| 4 | 12 | 47 | 2 | 24 | 71 |
| 4 | 12 | 49 | 2 | 25 | 74 |
| 4 | 13 | 51 | 2 | 26 | 77 |
| 4 | 13 | 53 | 2 | 27 | 80 |

Fig. 12(C)
Possible combinations for k=4 and L=3

| K | m | Na | L | Nb | N |
|---|---|---|---|---|---|
| 4 | 1 | 3 | 3 | 3 | 6 |
| 4 | 1 | 5 | 3 | 4 | 9 |
| 4 | 2 | 7 | 3 | 6 | 13 |
| 4 | 2 | 9 | 3 | 7 | 16 |
| 4 | 3 | 11 | 3 | 9 | 20 |
| 4 | 3 | 13 | 3 | 10 | 23 |
| 4 | 4 | 15 | 3 | 12 | 27 |
| 4 | 4 | 17 | 3 | 13 | 30 |
| 4 | 5 | 19 | 3 | 15 | 34 |
| 4 | 5 | 21 | 3 | 16 | 37 |
| 4 | 6 | 23 | 3 | 18 | 41 |
| 4 | 6 | 25 | 3 | 19 | 44 |
| 4 | 7 | 27 | 3 | 21 | 48 |
| 4 | 7 | 29 | 3 | 22 | 51 |
| 4 | 8 | 31 | 3 | 24 | 55 |
| 4 | 8 | 33 | 3 | 25 | 58 |
| 4 | 9 | 35 | 3 | 27 | 62 |
| 4 | 9 | 37 | 3 | 28 | 65 |
| 4 | 10 | 39 | 3 | 30 | 69 |
| 4 | 10 | 41 | 3 | 31 | 72 |
| 4 | 11 | 43 | 3 | 33 | 76 |
| 4 | 11 | 45 | 3 | 34 | 79 |
| 4 | 12 | 47 | 3 | 36 | 83 |
| 4 | 12 | 49 | 3 | 37 | 86 |
| 4 | 13 | 51 | 3 | 39 | 90 |
| 4 | 13 | 53 | 3 | 40 | 93 |

$Na = m*k \pm 1$, $Nb = Rd[L*Na/k]$, $N = Na + Nb$

Fig. 13(A)
Possible combinations for k=6 and L=1

| k | m | Na | L | Nb | N |
|---|---|---|---|---|---|
| 6 | 1 | 5 | 1 | 1 | 6 |
| 6 | 1 | 7 | 1 | 2 | 9 |
| 6 | 2 | 11 | 1 | 2 | 13 |
| 6 | 2 | 13 | 1 | 3 | 16 |
| 6 | 3 | 17 | 1 | 3 | 20 |
| 6 | 3 | 19 | 1 | 4 | 23 |
| 6 | 4 | 23 | 1 | 4 | 27 |
| 6 | 4 | 25 | 1 | 5 | 30 |
| 6 | 5 | 29 | 1 | 5 | 34 |
| 6 | 5 | 31 | 1 | 6 | 37 |
| 6 | 6 | 35 | 1 | 6 | 41 |
| 6 | 6 | 37 | 1 | 7 | 44 |
| 6 | 7 | 41 | 1 | 7 | 48 |
| 6 | 7 | 43 | 1 | 8 | 51 |
| 6 | 8 | 47 | 1 | 8 | 55 |
| 6 | 8 | 49 | 1 | 9 | 58 |
| 6 | 9 | 53 | 1 | 9 | 62 |
| 6 | 9 | 55 | 1 | 10 | 65 |
| 6 | 10 | 59 | 1 | 10 | 69 |
| 6 | 10 | 61 | 1 | 11 | 72 |
| 6 | 11 | 65 | 1 | 11 | 76 |
| 6 | 11 | 67 | 1 | 12 | 79 |
| 6 | 12 | 71 | 1 | 12 | 83 |
| 6 | 12 | 73 | 1 | 13 | 86 |
| 6 | 13 | 77 | 1 | 13 | 90 |
| 6 | 13 | 79 | 1 | 14 | 93 |

Fig. 13(B)
Possible combinations for k=6 and L=2

| k | m | Na | L | Nb | N |
|---|---|---|---|---|---|
| 6 | 1 | 5 | 2 | 2 | 7 |
| 6 | 1 | 7 | 2 | 3 | 10 |
| 6 | 2 | 11 | 2 | 4 | 15 |
| 6 | 2 | 13 | 2 | 5 | 18 |
| 6 | 3 | 17 | 2 | 6 | 23 |
| 6 | 3 | 19 | 2 | 7 | 26 |
| 6 | 4 | 23 | 2 | 8 | 31 |
| 6 | 4 | 25 | 2 | 9 | 34 |
| 6 | 5 | 29 | 2 | 10 | 39 |
| 6 | 5 | 31 | 2 | 11 | 42 |
| 6 | 6 | 35 | 2 | 12 | 47 |
| 6 | 6 | 37 | 2 | 13 | 50 |
| 6 | 7 | 41 | 2 | 14 | 55 |
| 6 | 7 | 43 | 2 | 15 | 58 |
| 6 | 8 | 47 | 2 | 16 | 63 |
| 6 | 8 | 49 | 2 | 17 | 66 |
| 6 | 9 | 53 | 2 | 18 | 71 |
| 6 | 9 | 55 | 2 | 19 | 74 |
| 6 | 10 | 59 | 2 | 20 | 79 |
| 6 | 10 | 61 | 2 | 21 | 82 |
| 6 | 11 | 65 | 2 | 22 | 87 |
| 6 | 11 | 67 | 2 | 23 | 90 |
| 6 | 12 | 71 | 2 | 24 | 95 |
| 6 | 12 | 73 | 2 | 25 | 98 |
| 6 | 13 | 77 | 2 | 26 | 103 |
| 6 | 13 | 79 | 2 | 27 | 106 |

Fig. 13(C)
Possible combinations for k=6 and L=3

| k | m | Na | L | Nb | N |
|---|---|---|---|---|---|
| 6 | 1 | 5 | 3 | 3 | 8 |
| 6 | 1 | 7 | 3 | 4 | 11 |
| 6 | 2 | 11 | 3 | 6 | 17 |
| 6 | 2 | 13 | 3 | 7 | 20 |
| 6 | 3 | 17 | 3 | 9 | 26 |
| 6 | 3 | 19 | 3 | 10 | 29 |
| 6 | 4 | 23 | 3 | 12 | 35 |
| 6 | 4 | 25 | 3 | 13 | 38 |
| 6 | 5 | 29 | 3 | 15 | 44 |
| 6 | 5 | 31 | 3 | 16 | 47 |
| 6 | 6 | 35 | 3 | 18 | 53 |
| 6 | 6 | 37 | 3 | 19 | 56 |
| 6 | 7 | 41 | 3 | 21 | 62 |
| 6 | 7 | 43 | 3 | 22 | 65 |
| 6 | 8 | 47 | 3 | 24 | 71 |
| 6 | 8 | 49 | 3 | 25 | 74 |
| 6 | 9 | 53 | 3 | 27 | 80 |
| 6 | 9 | 55 | 3 | 28 | 83 |
| 6 | 10 | 59 | 3 | 30 | 89 |
| 6 | 10 | 61 | 3 | 31 | 92 |
| 6 | 11 | 65 | 3 | 33 | 98 |
| 6 | 11 | 67 | 3 | 34 | 101 |
| 6 | 12 | 71 | 3 | 36 | 107 |
| 6 | 12 | 73 | 3 | 37 | 110 |
| 6 | 13 | 77 | 3 | 39 | 116 |
| 6 | 13 | 79 | 3 | 40 | 119 |

$Na=m*k\pm1$, $Nb=Rd(L*Na/k)$, $N=Na+Nb$

THIRD EMBODIMENT

FOURTH EMBODIMENT

CONVENTIONAL PRINTING SCHEME

○ : Recorded dot

DOT PRINTING WITH PARTIAL DOUBLE SCANNING OF RASTER LINES

BACKGROUND OF THE INVENTION

1. Field of the Invention

The present invention relates to a technique of recording dots on a printing medium with a dot-recording head.

2. Description of the Related Art

Ink jet printers such as serial scan-type printers and drum scan-type printers are dot recording apparatus that record dots on a printing medium with a dot-recording head while carrying out scans both in a main scanning direction and in a sub-scanning direction. An ink jet printer has a plurality of nozzles formed on a print head to spout ink and thereby print characters and images on a printing medium. Each nozzle on a print head has a pressure chamber filled with ink and an electrical-to-mechanical conversion element. Application of an electric signal to the electrical-to-mechanical conversion element produces a pressure in the pressure chamber and causes ink droplets to jet out from the nozzle.

Picture quality improvement has been one of major issues for ink jet printers. One proposed technique is the "interlace printing" disclosed in U.S. Pat. No. 4,198,642. FIG. 16 shows a conventional interlace printing scheme. A print head 1 has eleven nozzles #1–#11. A pitch k of the nozzles in the sub-scanning direction is set equal to 4 dots. Here the unit [dot] is defined as a minimum pitch P [inch] of dots in the sub-scanning direction recorded on the printing medium, and thus k dots correspond to k×P inches. In FIG. 16, the position of the print head 1 shown as pass 1, pass 2, or the like represents the position in the sub-scanning direction in each main scan. The term "pass" means one main scan. After each main scan, a sub-scan feed is carried out by a fixed amount F of 11 dots.

In the conventional interlace printing, the following two conditions are set to prevent skipping and overwriting of main scanning lines (hereinafter also referred to as "raster lines"):

[Condition 1] Number of used nozzles N and nozzle pitch k being relatively prime. (Two integers are said to be "relatively prime" if they have no common denominator other than 1.)

[Condition 2] Sub-scan feed amount F being identical with number of used nozzles N.

Printing speed increase and picture quality improvement are two major issues for the ink jet printers. The number of nozzles provided on a print head is to be increased to raise the printing speed In the interlace printing scheme, since the sub-scan feed amount F is set equal to the number of used nozzles N, the increase in the number of nozzles increases the sub-scan feed amount.

Mechanical accuracy of the sub-scan feed is, however, worsened substantially in proportion to the increase in sub-scan feed amount. The increase in the number of nozzles thus results in worsening the accuracy of the sub-scan feed. Especially when plural cycles of sub-scan feeds are carried out between recording of two adjacent raster lines, the feed errors due to the plural cycles of sub-scan feeds are accumulated and thereby significantly changes a pitch between the adjacent raster lines from a normal pitch. For example, in FIG. 16, three sub-scan feeds are carried out between the main scan of the second raster line and that of the third raster line. The pitch between these two raster lines is accordingly affected by the accumulated errors due to the sub-scan feeds.

FIG. 17 shows dots recorded in the conventional interlace printing scheme of FIG. 16. The pitch between the second raster line and the third raster line is increased by the accumulated errors due to the sub-scan feeds. This causes observable strip-like deterioration of the picture quality, which is called the "banding". Since the banding deteriorates the picture quality, it has been long demanded to reduce the occurrence of banding.

SUMMARY OF THE INVENTION

Accordingly, an object of the present invention is to reduces the occurrence of banding in a printed image.

In order to attain the above and other objects of the present invention, there is provided an apparatus for recording dots on a surface of a printing medium with a dot-recording head. The apparatus comprises: a dot-forming element array comprising a plurality of dot-forming elements which are arranged at a substantially constant pitch in a sub-scanning direction on the dot-recording head to face the printing medium and form a plurality of dots of the same color; a main scanning driver which drives the printing medium to carry out a main scan; a head driver which activates at least part of the plurality of dot-forming elements to form dots in the course of the main scan; and a sub-scanning driver which drives the printing medium to carry out a sub-scan every time when the main scan is complete. The sub-scanning driver carries out a sub-scan feed by a constant amount F×P (where P denotes a minimum pitch of dots in the sub-scanning direction and F is an integer). When the pitch of the plurality of dot-forming elements in the sub-scanning direction is expressed as k×P (where k is an integer of not less than 3), a number of dot-forming elements N used in one main scan (where N is an integer of not less than 3) and parameters Na, Nb, m, and L satisfy Equations (1)–(4)

$$N=Na+Nb \tag{1}$$

$$Na=m\times k\pm 1 \tag{2}$$

$$Nb=Rd(L\times Na\div k) \tag{3}$$

$$F=Na \tag{4}$$

where m is an integer of not less than 1, L is an integer satisfying a relation of $1\leqq L<k$, and an operator Rd( ) denotes an operation of rounding a decimal fraction in parentheses.

In the dot recording apparatus of the present invention, there are two types of main scanning lines: first type of main scanning lines are recorded only by one nozzle and second type of main scanning lines are recorded by two nozzles. The two types of main scanning lines are arranged substantially in a regular manner to complete recording of dots with respect to one color. The second type of main scanning lines are recorded by two nozzles and thereby reduce the occurrence of "banding". The second type of main scanning lines, however, require twice the scanning time of the first type of main scanning lines and thus halves the recording speed If the conditions of Equations (1) through (4) are satisfied, some main scanning lines are of the first type. This relieves the decrease in recording speed, compared with recording of all the main scanning lines as the second type.

The head driver may drive the dot-recording head to cause dots recorded by Nb dot-forming elements and dots recorded by Na dot-forming elements to have a complementary positional relationship on each main scanning line. Alternatively, the head driver may drive the dot-recording head to cause dots recorded by Nb dot-forming elements to overlap dots recorded by Na dot-forming elements on each main scanning line.

In a preferred embodiment, the dot-recording head comprises a plurality of the dot-recording element arrays which are used to record dots of plural colors, respectively; and the dot-recording elements in the plurality of dot-recording element arrays are arranged so that the plurality of dot-recording element arrays can record identical main scanning lines during one main scan. The head driver drives the dot-recording head to record dots in both ways of reciprocating main scan motion. This arrangement enables the difference in color between the main scanning lines recorded in the respective ways of the reciprocating motion to be inconspicuous.

The present invention is also directed to a method of recording dots and to a computer program product implementing the above scheme.

These and other objects, features, aspects, and advantages of the resent invention will become more apparent from the following detailed description of the preferred embodiments with the accompanying drawings.

BRIEF DESCRIPTION OF THE DRAWINGS

FIGS. 3(A) and 3(B) show an arrangement of ink jet nozzles on a print head;

FIG. 5 shows raster line numbers subject to recording by respective nozzles in the first embodiment;

FIG. 6 shows print data allocation to the nozzles in the first embodiment;

FIG. 7 shows an example of dots recorded in the first embodiment;

FIG. 8 shows an example of dots recorded when raster starting position is shifted;

FIG. 9 is a graph showing the relationship between the spatial frequency and the number of discriminating tones in the visual characteristic of the human being.

FIG. 11 shows print data allocation to the respective nozzles in the second embodiment;

FIGS. 12(A)–12(C) show possible combinations of parameters under the conditions of k=4 and L=1 to 3;

FIGS. 13(A)–13(C) show possible combinations of parameters under the conditions of k=6 and L–1 to 3;

DESCRIPTION OF THE PREFERRED EMBODIMENT

A. Apparatus Structure

Figure 1:
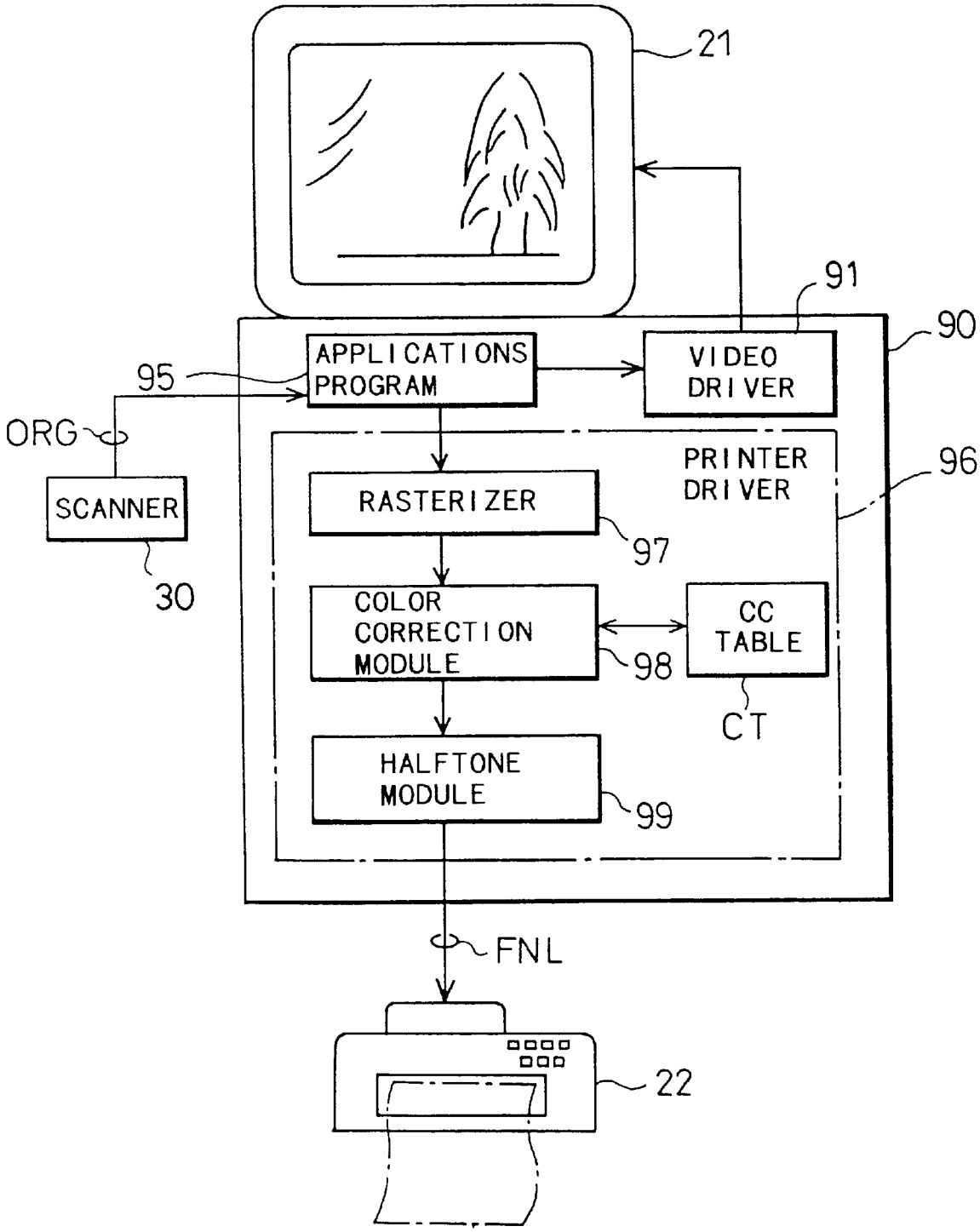
FIG. 1 is a block diagram schematically illustrating an image processing system embodying the present invention.

FIG. 1 is a block diagram illustrating the structure of a color image processing system embodying the present invention. The color image processing system comprises a scanner 30, a personal computer 90, and an ink jet printer 22. The personal computer 90 is provided with a color display 21. The scanner 30 reads color image data from a color original and supplies original color image data ORG, consisting of three color components of R, G, and B, to the computer 90.

The computer 90 comprises a CPU, a RAM, a ROM, and other elements, none of which are shown. An applications program 95 is executed under a specific operating system in which a video driver 91 and a printer driver 96 are incorporated. Final color image data or print data FNL are output from the applications program 95 via these drivers. The applications program 95 used to, for example, retouch an image, reads an image from the scanner and causes the input image to be subjected to a specific processing, while displaying the image on the CRT display 21 via the video driver 91. When the applications program 95 outputs a printing instruction, the printer driver 96 in the computer 90 receives image information from the applications program 95 and converts the input image information to signals printable by the ink jet printer 22 (in this example, binarized signals for the respective colors C, M, Y, and K). In the example of FIG. 1, the printer driver 96 includes: a rasterizer 97 that converts the color image data processed by the applications program 95 to dot-based image data; a color correction module 98 that causes the dot-based image data to be subjected to color correction according to the ink colors C, M, and Y used by the ink jet printer 22 and the calorimetric characteristics of the ink jet printer 22; a color correction table CT referred to by the color correction module 98; and a halftone module 99 that generates halftone image data, which express density in a specific area by formation or non-formation of an ink dot in each dot area, from the color-corrected image data.

Figure 2:
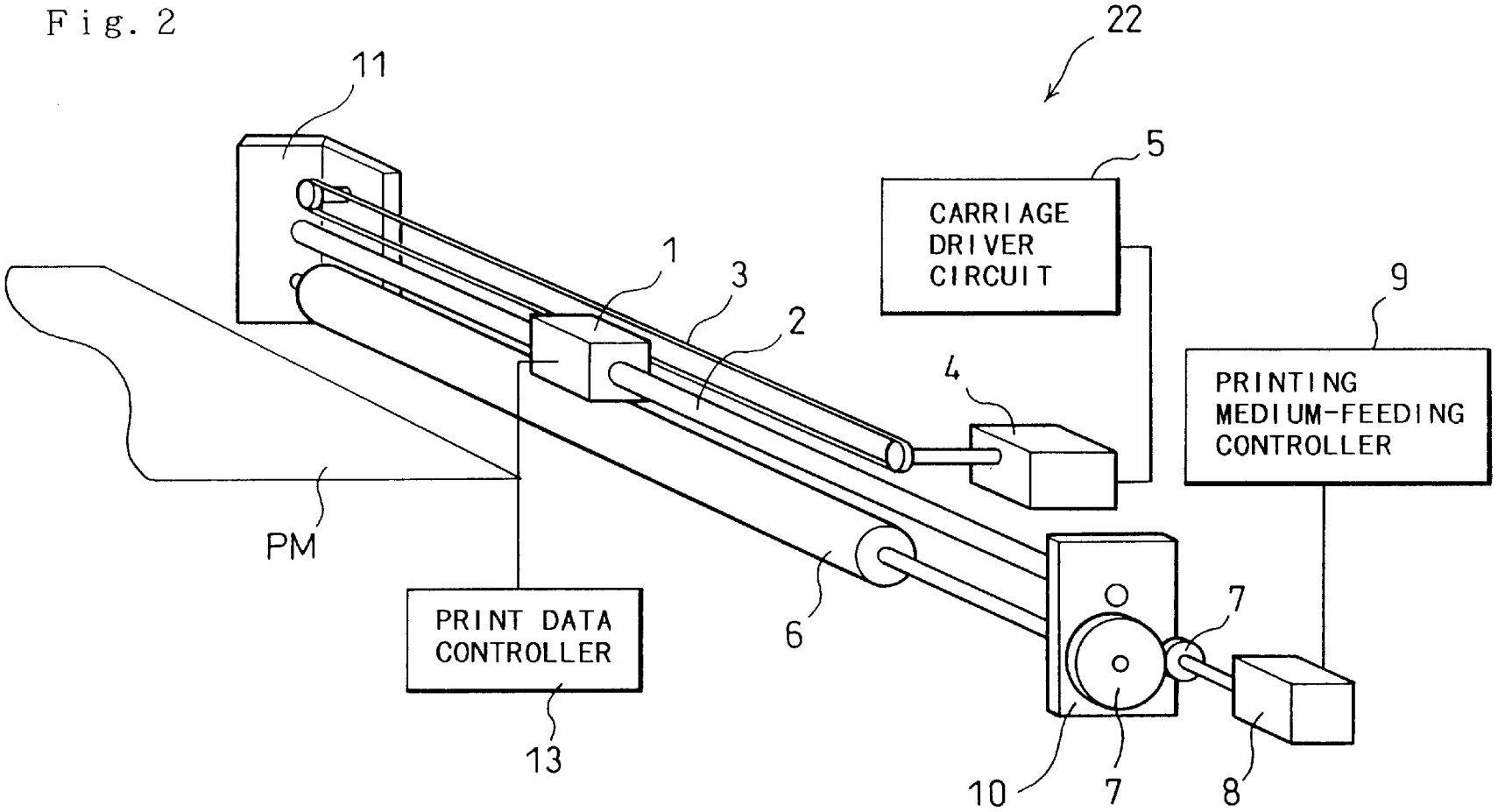
FIG. 2 conceptually illustrates the structure of an ink jet printer embodying the present invention.

FIG. 2 conceptually illustrates the structure of the ink jet printer 22. This ink jet printer 22 comprises: a print head 1; a carriage shaft 2; a carriage belt 3; a main scanning motor 4; a carriage driver circuit 5 which drives the main scanning motor 4, a platen roller 6; a gear unit 7; a sub-scanning motor 8; a printing medium-feeding controller 9 which drives the sub-scanning motor 8 to feed a printing medium PM; a pair of fixation bases 10 and 11; and a print data controller 13. The combination of the platen roller 6, the gear unit 7, the sub-scanning motor 8, and the printing medium-feeding controller 9 constitute a sub-scanning drive unit. The combination of the carriage driver circuit 5, the printing medium-feeding controller 9, and the print data controller 13 may be realized by one controller. An additional controller for comprehensively controlling these circuits 5, 9, and 13 may be provided separately.

The carriage driver circuit 5 drives the main scanning motor 4 to carry out main scans. When the main scanning motor 4 shifts the carriage belt 3, the print head 1 fixed to the carriage belt 3 reciprocates between the two fixation bases 10 and 11. The print head 1 spouts ink droplets onto the printing medium PM in response to print data supplied from the print data controller 13 in the course of either way of the reciprocating motion. After conclusion of one main scan, the printing medium-feeding controller 9 drives the sub-scanning motor 8 to feed the printing medium PM by a predetermined amount.

FIGS. 3(A) and 3(B) show an arrangement of ink jet nozzles on the print head 1. The print head 1 has four nozzle arrays 61–64 for four color inks, respectively. The first through fourth nozzle arrays 61–64 respectively spout inks of black (K), cyan (C), magenta (M), and yellow (Y). Each nozzle is provided with a piezoelectric element (not shown) functioning to spout ink. The piezoelectric element is driven responsive to the print data supplied from the print data controller 13 to cause each nozzle to spout ink.

Each of the four nozzle arrays 61–64 has a plurality of nozzles n (for example, 32 or 48 nozzles) which are arranged in zigzag at a fixed nozzle pitch k in the sub-scanning direction. The plurality of nozzles n included in each nozzle array may be arranged in alignment instead of in zigzag. The zigzag arrangement as shown in FIG. 3(A), however, has the advantage of being easier to reduce the nozzle pitch k.

FIG. 3(B) shows an arrangement of a plurality of dots formed by one nozzle array. In this embodiment, driving signals are transmitted to piezoelectric elements (not shown) for driving the respective nozzles, so that a plurality of dots formed by one nozzle array are substantially aligned in the sub-scanning direction, whether the ink nozzles are arranged in zigzag or in alignment. By way of example, when the nozzle array has a zigzag arrangement as shown in FIG. 3(A), the timing of outputting the driving signal to one column of nozzles in each nozzle array is delayed from the timing of outputting the drive signal to another column of nozzles in the nozzle array by a time period d/v [second], which is obtained by dividing a pitch d [inch] between the two nozzle columns by a main scan driving velocity v [inch/second]. This enables a plurality of dots formed by one nozzle array to be aligned in the sub-scanning direction. As described later, some dot printing schemes use not all of but only part of the plurality of nozzles provided in each of the nozzle arrays 61–64.

The plurality of nozzles n respectively included in the four nozzle arrays 61–64 are arranged at the same positions in the sub-scanning direction, so that four color dots are formed on a plurality of identical main scanning lines during one main scan.

B. Embodiments of Dot Printing Scheme

Figure 4:
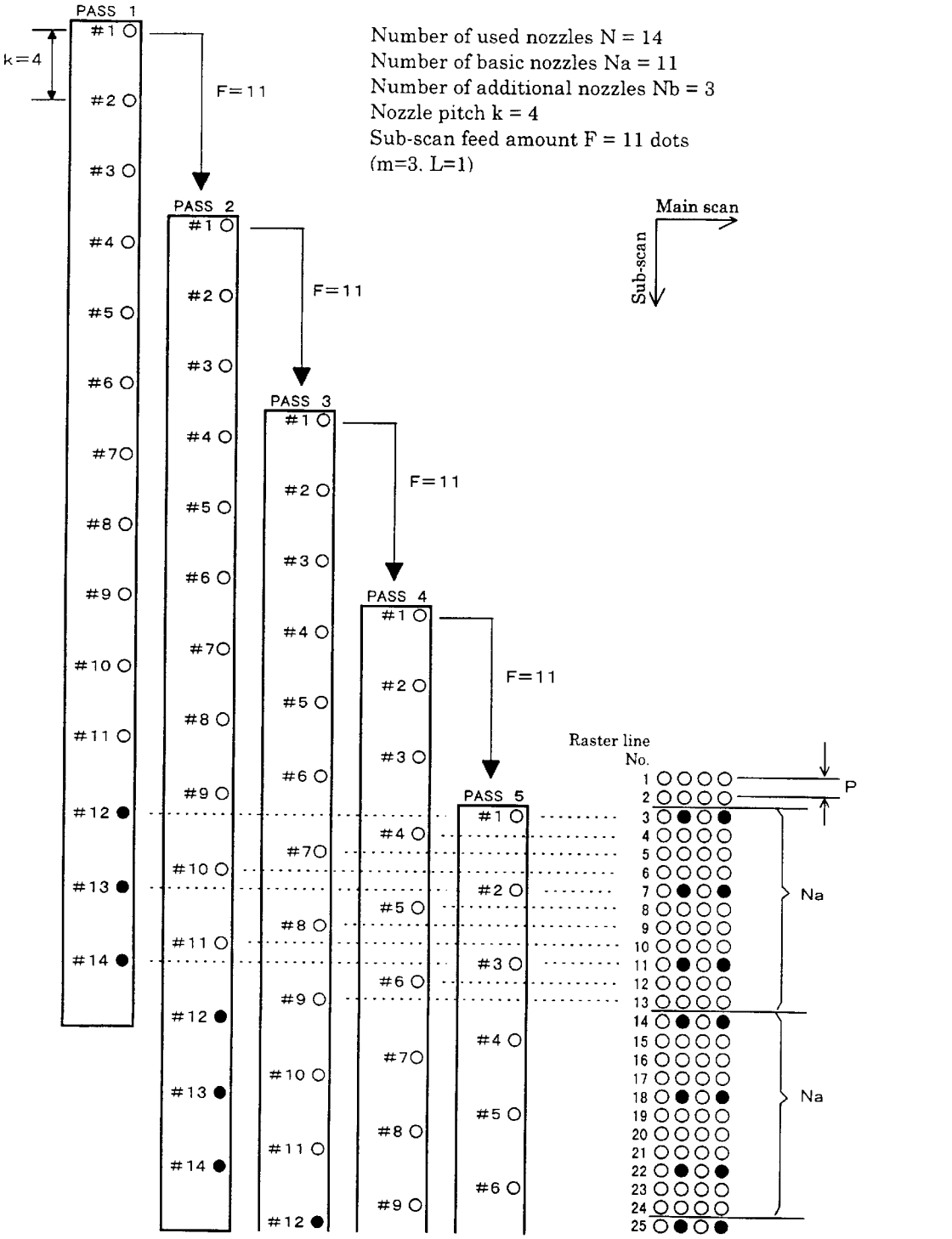
FIG. 4 illustrates a dot printing scheme as a first embodiment according to the present invention.

FIG. 4 illustrates a dot printing scheme as a first embodiment according to the present invention. This dot printing scheme satisfies equations (1)–(4) given below again:

$$N=Na+Nb \quad (1)$$

$$Na=m\times k\pm 1 \quad (2)$$

$$Nb=Rd(L\times Na\div k) \quad (3)$$

$$F=Na \quad (4)$$

where N denotes the number of used nozzles, k denotes a nozzle pitch [dot], m is an integer of not less than 1, L is an integer satisfying the relation of $1\leqq L<k$, F denotes an sub-scan feed amount [dot], and the operator "Rd( )" denotes an operation of rounding a decimal fraction in parentheses. The operator "±" denotes either addition or subtraction.

In the dot printing scheme of FIG. 4, the parameters are set as N=14, Na=11, Nb=3, k=4, F=11, m=3, and L=1, respectively. In this example, the operation ± on the right-hand side of Equation (2) is subtraction, and the rounding operation Rd( ) on the right-hand side of Equation (3) is raising to a unit. A dot pitch (print pitch) P in the sub-scanning direction is, for example, a value corresponding to the printing resolution of 720 dpi (that is, 1/720 inch).

Figure 16:
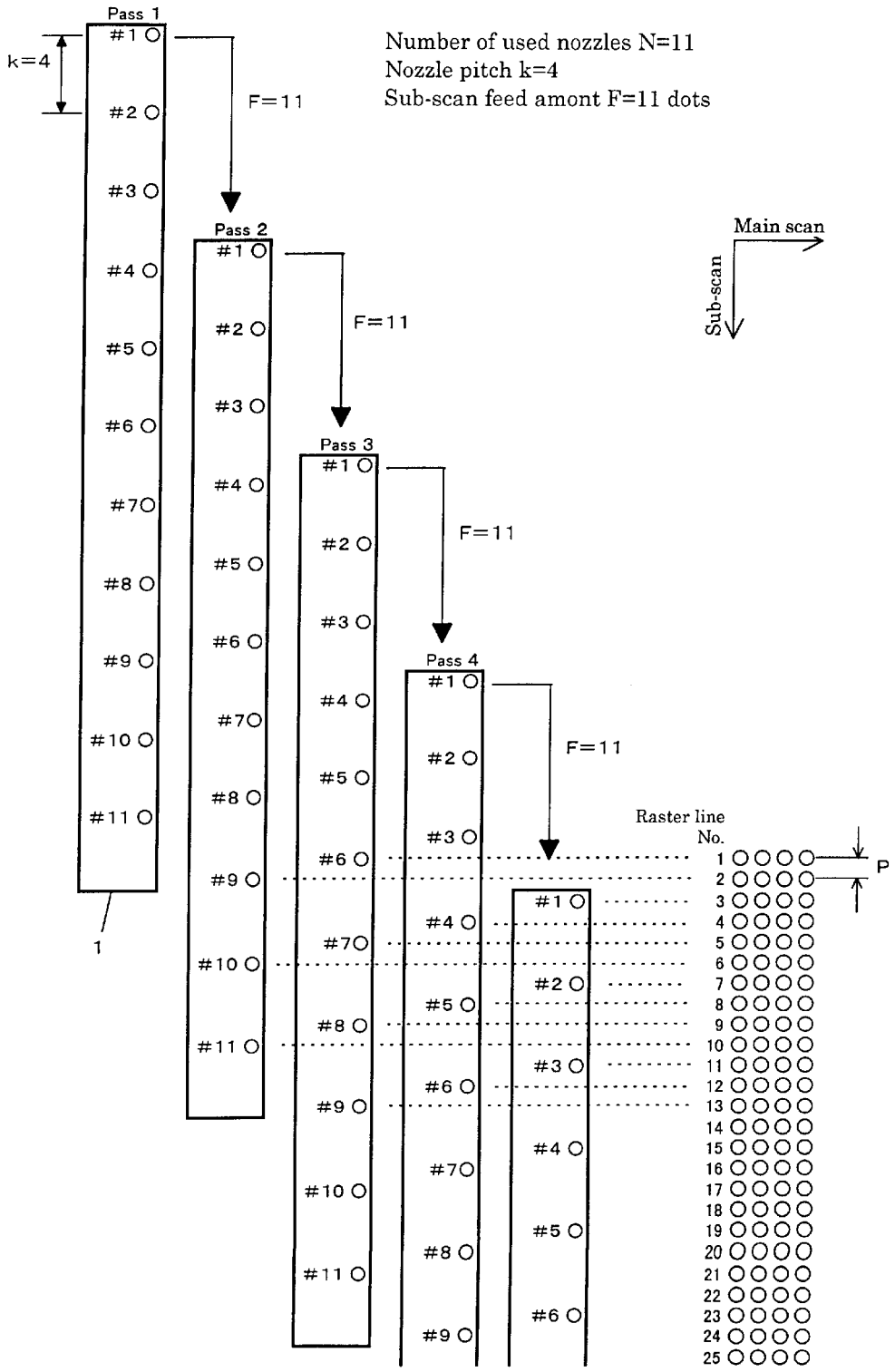
FIG. 16 illustrates a conventional dot printing scheme.

As expressed by Equation (1), the number of used nozzles N is the sum of two integers Na and Nb. The first integer Na is equal to the sub-scan feed amount F; the integer Na accordingly corresponds to the number of used nozzles in the conventional interlace printing scheme shown in FIG. 16. In the description below, the first integer Na is referred to as "number of basic nozzles", and the nozzles included in the number of basic nozzles Na are referred to as "basic nozzles". The second integer Nb is referred to as "number of additional nozzles", and the nozzles included in the number of additional nozzles Nb are referred to as "additional nozzles". In the example of FIG. 4, nozzles #1–#11 are basic nozzles and nozzles #12–#14 are additional nozzles. The significance of the number of basic nozzles Na and the number of additional nozzles Nb will be described later in detail.

The right-half of FIG. 4 shows dots recorded on the printing medium. The range of raster lines existing below a raster line number 1 represents an actual range of recording (effective recording area).

FIG. 5 shows raster line numbers subject to recording by respective nozzles in each pass. In pass 1 (first main scan), print data are supplied to the three additional nozzles #12, #13, and #14, and dots are recorded on the third, seventh, and eleventh raster lines while the print head 1 moves in the main scanning direction. In the first main scanning, the basic nozzles #1–#11 are out of the effective recording area as shown in FIG. 4. The print data controller 13 accordingly supplies 0 data (non-record data) to the basic nozzles #1–#11. In a similar manner, in pass 2, print data are supplied to the six nozzles #9–#14 to record dots on six raster lines. At this moment, the nozzles #1–#8 are out of the effective recording area, so that the print data controller 13 supplies 0 data (non-record data) to these nozzles #1–#8.

As dearly shown by the pattern of recorded dots in FIG. 4, the raster lines partly recorded by the additional nozzles #12–#14 are also subject to recording by the basic nozzles. In the specification hereof, the raster lines subject to recording by both the basic nozzles and the additional nozzles are referred to as "overlap raster lines", whereas the raster lines recorded only by the basic nozzles are referred to as "non-overlap raster lines". In the example of FIG. 4, the raster lines of raster line numbers 3, 7, 11, . . . are overlap raster lines.

FIG. 6 shows allocation of print data to these three overlap raster lines. Print data for the respective pixels on the third raster line are 1,1,1,0,0,1, . . . The value "1" shows that a dot is recorded at the position of the pixel, whereas the value "0" shows that no dot is recorded at the position of the pixel. In the first embodiment, the additional nozzles record dots in the pixels of even ordinal numbers on the overlap raster lines, and the basic nozzles record dots in the pixels of odd ordinal numbers. When the additional nozzle #12 records dots on the third raster line in pass 1, print data for the even numbered pixels are supplied to the additional nozzle #12, whereas 0 data (non-record data) are supplied with respect to the odd numbered pixels. When the basic nozzle #1 records dots on the third raster line in pass 5, print data for the odd numbered pixels are supplied to the basic nozzle #1, whereas 0 data are supplied with respect to the even numbered pixels. The additional nozzle #12 records dots in alternate pixels in pass 1, and the basic nozzle #1 records dots in alternate pixels in the complementary manner in pass 5. This completes the recording on the third raster line.

In a similar manner, the additional nozzle #13 records dots at alternate pixels in pass 1, and the basic nozzle #2 records dots at the other alternate pixels in the complementary manner in pass 5. This completes the recording on the seventh raster line. The additional nozzle #14 records dots at alternate pixels in pass 1, and the basic nozzle #3 records dots at the other alternate pixels in the complementary manner in pass 5. This completes the recording on the eleventh raster line.

As described above, pixels on a overlap raster line are intermittently recorded by one additional nozzle in the course of one main scan and then complementarily recorded by one basic nozzle in the course of another main scan. This completes recording of all the pixels on the overlap raster line. In short, an overlap raster line is recorded complementarily by one additional nozzle and one basic nozzle. The term "being recorded complementarily" here means that all the pixels on one raster line are recorded by the additional nozzle and the basic nozzle without skipping and overwriting.

The printing medium-feeding controller 9 (FIG. 2) feeds the printing medium PM in the sub-scanning direction by Na dots (that is, P×Na inches) every time when one main scan is complete. The print head 1 accordingly shifts, for example, from the position of pass 1 to the position of pass 2 in FIG. 4. In pass 5, the three basic nozzles #1–#3 are positioned on the raster lines which have already been recorded partly by the additional nozzles #12–#14 (the third, the seventh, and the eleventh raster lines). The basic nozzles #1–#3 then record dots at the residual odd numbered pixels on these overlap raster lines responsive to the print data shown in FIG. 6. This completes complementary recording with respect to the three overlap raster lines. Repeating this procedure enables characters and images to be formed on the printing medium PM.

FIG. 7 shows dots recorded according to the printing scheme of the first embodiment. Open circles represent dots recorded by the basic nozzles, whereas closed circles represent dots recorded by the additional nozzles. In this example, the position of the dots recorded by the additional nozzle on a certain raster line is a little deviated, in the sub-scanning direction (in the vertical direction in the drawing of FIG. 7), from the position of the dots recorded by the basic nozzle on the same raster line.

As described in the prior art, plural cycles of sub-scan feeds between recording of two adjacent raster lines accumulate errors due to the plural cycles of sub-scan feeds, thereby changing the pitch between the two adjacent raster lines from the normal pitch, which results in the "banding". In the printing scheme of the first embodiment, however, since part of the dots on one raster line of the two adjacent raster lines are recorded by the additional nozzle, the change of the raster line pitch is not so conspicuous as to be recognized as the "banding" even when the sub-scan feed errors are accumulated between recording of the two adjacent raster lines. This is because the position of the dots recorded by the additional nozzle on the raster line is a little deviated in the sub-scanning direction from the position of the dots recorded by the basic nozzle on the same raster line as shown in FIG. 7.

FIG. 8 shows another example, in which the dots recorded by the basic nozzles #1–#11 and the dots recorded by the additional nozzles #12–#14 have positional shifts in the raster direction (in the main scanning direction). Such positional shifts are caused by the detection errors at the recording-start positions of the print head 1 in the raster direction. As shown in FIG. 8, the positional shift in the raster direction causes the adjacent dots to be overlapped regularly by a fixed amount in the raster direction on the raster line recorded by only the basic nozzle. On the raster line recorded complementarily by both the basic nozzle and the additional nozzle, on the other hand, there is shown a large overlap at each pairs of dots. This varies the density in the raster direction and increases the possibility of recognition as the banding. As shown in the graph of FIG. 9, however, the vision of the human being is characterized by that the discriminating power of the density difference decreases with an increase in spatial frequency. When it is assumed that the pitch of dots in the sub-scanning direction is 720 dpi, the pitch of the banding due to the positional shift in the raster direction as shown in FIG. 8 corresponds to 4 raster lines and is equal to $4/720$ inch=0.14 mm. The spatial frequency corresponding to the pitch (that is, the reciprocal of the pitch) is approximately 7 cycles/mm. The graph of FIG. 9 shows that the banding at this spatial frequency is visually unrecognizable.

Figure 17:
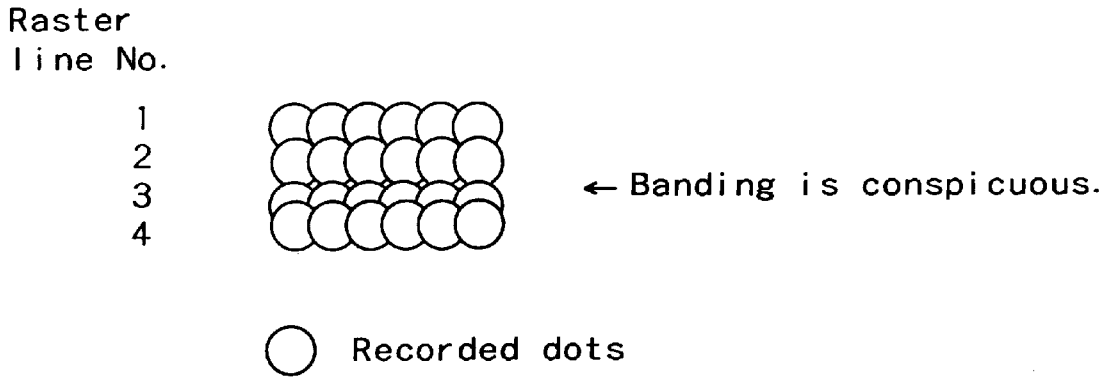
FIG. 17 shows an example of banding.

Even when the banding occurs in the printing scheme of the first embodiment and has the spatial frequency similar to that of the banding occurring by the technique of U.S. Pat. No. 4,198,642 described above, the printing scheme of the first embodiment significantly makes the banding unrecognizable as dearly shown by the comparison between FIG. 7 and FIG. 17.

Figure 10:
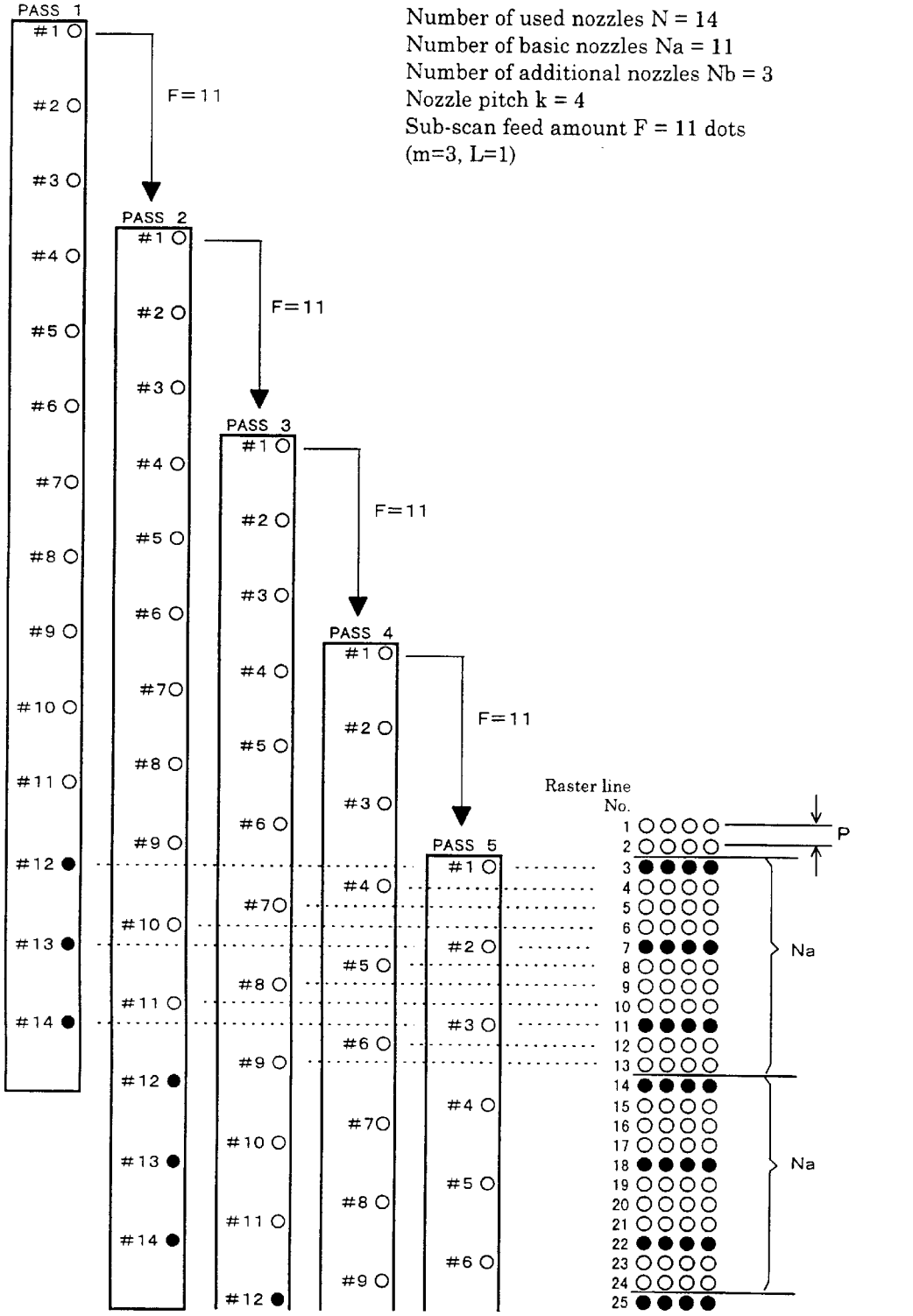
FIG. 10 illustrates another dot printing scheme as a second embodiment according to the present invention.

FIG. 10 illustrates another dot printing scheme as a second embodiment according to the present invention. The difference from the first embodiment shown in FIG. 4 is that each overlap raster is recorded fully by one additional nozzle and recorded fully again by one basic nozzle, respectively. For example, the basic nozzle #1 and the additional nozzle #12 respectively record dots at all the pixel positions on the third raster line.

FIG. 11 shows allocation of print data in the second embodiment. This table corresponds to FIG. 6 in the first embodiment. In the second embodiment, one basic nozzle and one additional nozzle respectively record dots at all the pixels on an identical raster line. All the print data for the raster line are thus supplied respectively to the basic nozzle (for example, the nozzle #1) and the additional nozzle (for example, the nozzle #12).

The printing scheme of the second embodiment makes the spatial frequency of the banding relatively short like the first embodiment, but causes the density difference to be more recognizable than the first embodiment. In case that the density difference is conspicuous, the printing scheme of the first embodiment shown in FIG. 4 is preferable from the viewpoint of the picture quality. When the printing medium used has a large contact angle of the surface of the printing medium and ink, for example, when an overhead projector sheet is used as the printing medium, vacant spaces that are not filled with dots as shown in FIG. 8 are conspicuous in the maximum density area (in the solid recording area). Especially on the overhead projector sheet, which is primarily used for presentation, graphs and relatively large characters are used frequently and the result of solid recording is important. In this case, the printing scheme of the second embodiment is applied to recording dots multiple times to spread the dots, so as to fill the vacant spaces and improve the picture quality.

The selection of the first or second embodiment from the viewpoint of the picture quality depends upon the printing medium. Accordingly, either of the first and second embodiments may be selected according to the printing medium used, so as to record an image of high picture quality.

In the printing scheme of the first embodiment, the basic nozzle and the additional nozzle record dots in the complementary manner at the pixel positions on an identical raster. In the printing scheme of the second embodiment, the basic nozzle and the additional nozzle record dots in the overwriting manner at all the pixel positions on an identical raster. The applicable printing scheme is, however, not restricted to these schemes. By way of example, while the basic nozzle and the additional nozzle record dots in the complementary manner, the diameter of the dots recorded by the additional nozzle may be made greater than the diameter of the dots recorded by the basic nozzle. This exerts similar effects to those of the second embodiment.

Other than the first and the second embodiments, there are a variety of dot printing schemes that satisfy Equations (1)-(4) given previously. FIGS. 12(A)–12(C) show possible combinations of parameters under the conditions of k=4 and L=1 to 3. The fifth case of FIG. 12(A) where k=4, L=1, m=3, Na=11, Nb=3, and N=14 corresponds to the first embodiment shown in FIG. 4. FIGS. 13(A)–13(C) show possible combinations of parameters under the conditions of k=6 and L–1 to 3. In these example, raising to a unit is applied as the rounding operation Rd() in Equation (3), although omission may also be applicable instead.

As clearly understood from FIGS. 12(A)–12(C) and 13(A)–13(C), setting of the parameters m and L for a given nozzle pitch k determines the number of basic nozzles Na and the number of additional nozzles Nb. The sum of these values Na and Nb specifies the total number of used nozzles N. If the number of used nozzles N is given, on the contrary, the number of basic nozzles Na and the number of additional nozzles Nb corresponding to the given number of used nozzles N can be read from the tables of FIGS. 12(A)–12(C) and 13(A)–13(C). In these cases, the desirable values of the parameters m and L are determined by taking into account the significance of the respective parameters L, Na, and Nb, which will be described later.

Figure 14:
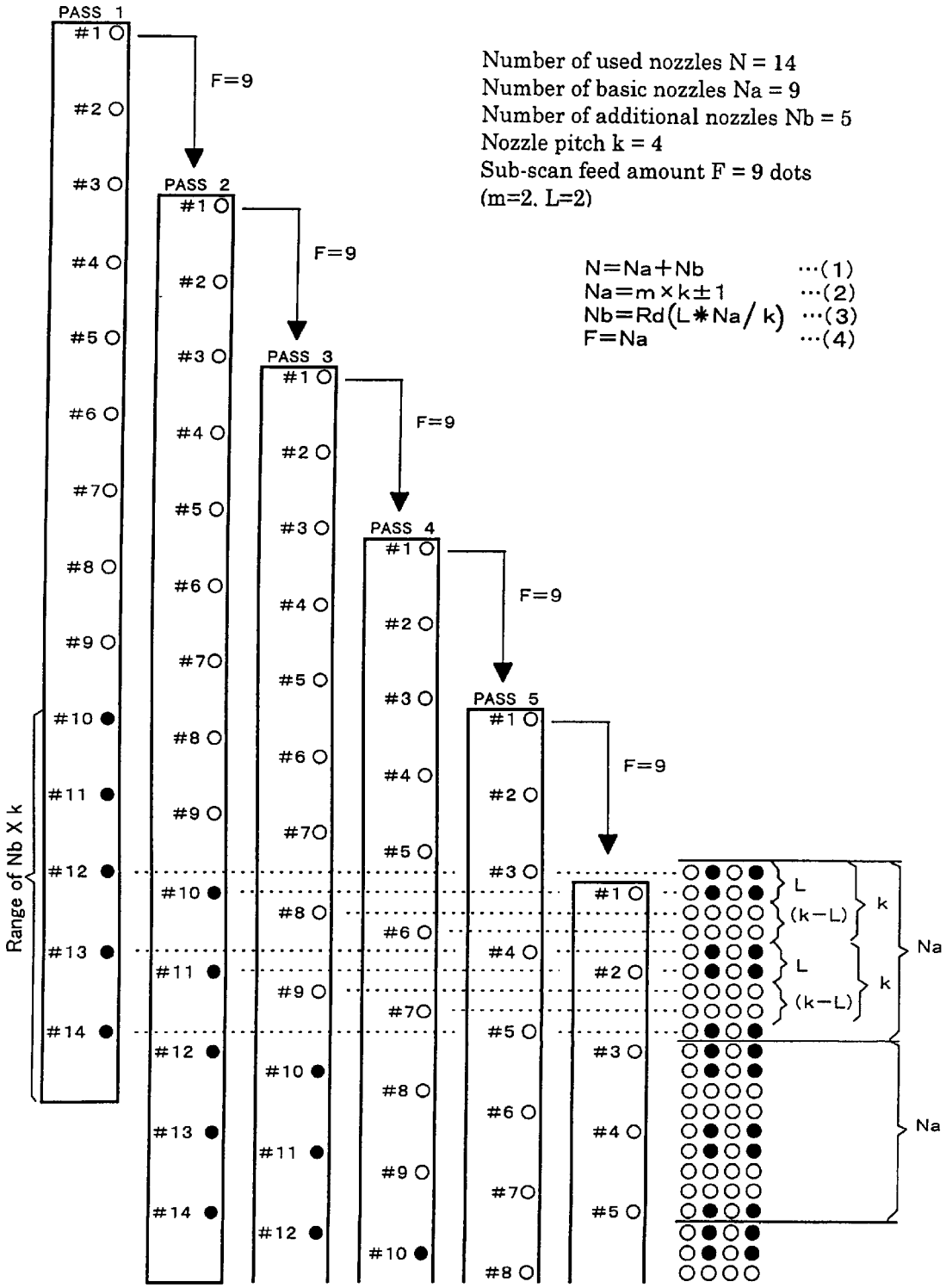
FIG. 14 illustrates still another dot printing scheme as a third embodiment according to the present invention.
Figure 15:
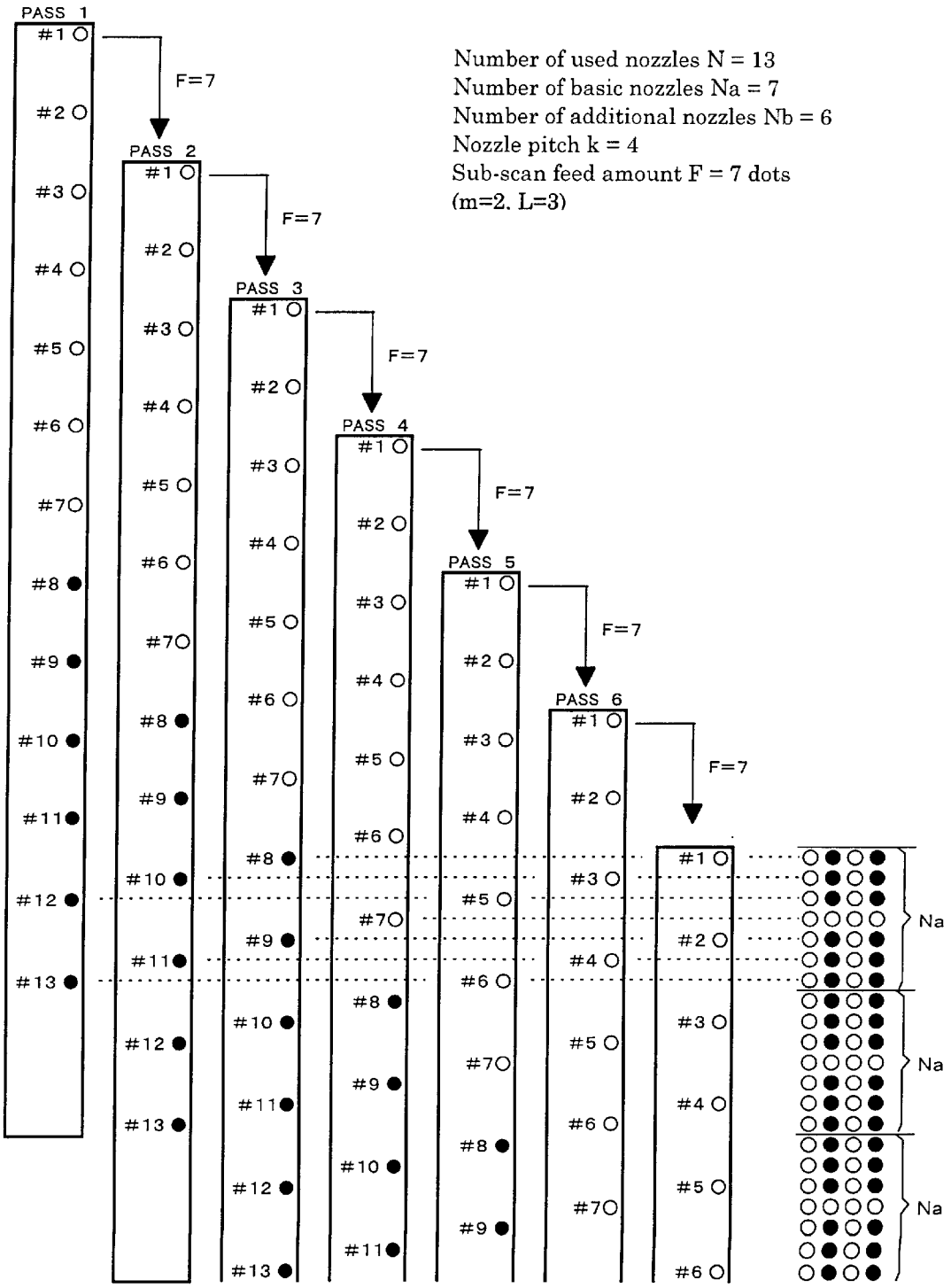
FIG. 15 illustrates another dot printing scheme as a fourth embodiment according to the present invention.

FIG. 14 illustrates still another dot printing scheme as a third embodiment according to the present invention, which corresponds to the fourth case of FIG. 12(B) where k=4, L=2, m=2, Na=9, Nb=5, and N=14. FIG. 15 illustrates another dot printing scheme as a fourth embodiment according to the present invention, which corresponds to the third case of FIG. 12(C) where k=4, L=3, m=2, Na=7, Nb=6, and N=13.

The meanings of the parameters in Equations (1)–(4) are shown in FIG. 14, which are as follows. According to Equations (2) and (4), the sub-scan feed amount F is set to a constant value of (m×k±1) dots. Namely the sub-scan feed amount F is set equal to the value obtained by adding one to or subtracting one from the integral multiple of the nozzle pitch k, m×k. If the sub-scan feed amount F were set equal to m×k, the respective nozzles after the sub-scan feed would be at the periodical positions of the nozzles before the sub-scan feed (that is, the positions of every k-th dot). When the sub-scan feed amount F is equal to (m×k+1) dots, the positions of the respective nozzles after the sub-scan feed are shifted in the sub-scanning direction by +1 or −1 dot from the periodical positions of the nozzles before the sub-scan feed. For example, in the embodiment of FIG. 14, the sub-scan feed amount F is equal to (2×4+1)=9 dots, and the positions of the nozzles after each sub-scan feed are accordingly shifted in the sub-scanning direction by +1 dot from the periodical positions of the nozzles before the sub-scan feed.

Equation (3) may be replaced by Equation (3a) given below by neglecting the rounding operator Rd in Equation (3) and substituting Equation (4):

$$L=(Nb\times k)/Na=(Nb\times k)/F \tag{3a}$$

The numerator (Nb×k) on the right-hand side of Equation (3a) is the product of the number of additional nozzles Nb and the nozzle pitch k, and it implies a range of the additional nozzles in the nozzle array. The range of the additional nozzles is from the raster position of the nozzle #10 to the raster position three dots below the nozzle #14 in the embodiment of FIG. 14. Equation (3a) shows that the parameter L is approximately equal to the value obtained through dividing (Nb×k) by the sub-scan feed amount F. The parameter L thus represents how many sub-scan feeds are carried out for a specific nozzle (for example, the additional nozzle #10 at the upper-most end) to pass the range of the additional nozzles. As described above, one sub-scan feed shifts the respective nozzles by one dot from the periodical positions of the nozzles immediately before the sub-scan feed. Here it is assumed that the sub-scan feed is carried out L times after a certain main scan. The additional nozzle #10 at the upper-most end remains in the range of the additional nozzles, which is defined at the certain main scan, during the L sub-scan feeds while every sub-scan feed shifts the additional nozzle #10 by one dot from the preceding periodical nozzle positions. For example, in the embodiment of FIG. 14, the additional nozzle #10 at the upper-most end remains in the range of the additional nozzles, which is defined at pass 1, during two sub-scan feeds after pass 1, while every sub-scan feed shifts the additional nozzle #10 by one dot from the preceding periodical nozzle positions. In pass 2, the additional nozzle #10 at the upper-most end is positioned one dot after the position of the nozzle #12 in the preceding pass 1 in the range of the additional nozzles which is defined at pass 1. In pass 3, the additional nozzle #10 at the upper-most end is positioned one dot after the position of the nozzle #12 in the preceding pass 2 in the range of the additional nozzles which is defined at pass 1.

Based on the shift of the nozzle position, it can be thought that the parameter L represents how many overlap raster lines (that is, the raster lines recorded by both the basic nozzle and the additional nozzle) are arranged in the consecutive manner. For example, in the third embodiment shown in FIG. 14, L is equal to two, which shows two overlap raster lines are consecutively arranged. (n some portions of FIG. 14, three overlap raster lines are consecutively arranged. The reason of such arrangement will be described later.) It should be also noted that the additional nozzles are arranged at the nozzle pitch k in the nozzle array. Among the k consecutive raster lines, the first L lines are overlap raster lines, whereas the remaining (k–L) lines are non-overlap raster lines. The set of k raster lines including L overlap raster lines and (k–L) non-overlap raster lines is repeated to complete the arrangement of raster lines.

Among the Na raster lines recorded by the Na basic nozzles in one main scan, Nb raster lines are overlap raster lines which are recorded also by the Nb additional nozzles, whereas the remaining (Na–Nb) raster lines are non-overlap raster lines. Namely the set of k raster lines including L overlap raster lines and (k–L) non-overlap raster lines is repeatedly arranged in the range of Na raster lines. As a result, among the Na raster lines, the Nb lines are overlap raster lines and the remaining (Na–Nb) lines are non-overlap raster lines. For example, in the third embodiment shown in FIG. 14, since k=4, Na=9, and Nb=5, the set of raster lines including two overlap raster lines and two non-overlap raster lines is repeatedly arranged in the range of nine raster lines. This results in five overlap raster lines and four non-overlap raster lines among the nine raster lines.

The right-half of FIG. 14 shows divisions by every Na raster lines. In this example, the last raster line in one division of Na raster lines is the overlap raster line, and the first L (=2) raster lines in a next division of Na raster lines are also the overlap raster lines. This causes three overlap raster lines to be consecutive on the boundary between raster divisions of every Na lines. Basically, however, it is understood that the set of k raster lines including L overlap raster lines and (k–L) non-overlap raster lines is repeated in the arrangement of raster lines in FIG. 14.

The above relationship between the parameters k, L, Na, and Nb and the arrangement of the overlap raster lines and the non-overlap raster lines is also held in the other embodiments as dearly understood from FIGS. 4, 10, and 15.

In the respective embodiments described above, the overlap raster lines and the non-overlap raster lines are arranged in a substantially regular manner according to the parameters k, L, Na, and Nb. More concretely, about L number of consecutive overlap raster lines are arranged in a substantially regular manner across about (k–L) number of non-overlap raster lines. These overlap raster lines make the banding sufficiently inconspicuous.

In the case of two-way printing that carries out main scans in forward and backward directions, the above arrangement of overlap raster lines has the following effects. When the nozzle arrays of four color inks Y, M, C, and K are arranged to record the same raster line as shown in FIG. 3(A), dots of the respective colors are formed on each raster line in the sequence of K, C, M, and Y in a forward scan. In a backward scan, dots of the respective colors are formed on each raster line in the reversed sequence of Y, M, C, and K. This possibly causes a difference in color between the raster lines recorded in the forward scan and the raster lines recorded in the backward scan. When the dots are recorded by the conventional interlace printing method without forming any overlap raster lines, the difference in color between the raster lines recorded in the forward scan and those recorded in the backward scan is rather conspicuous and undesirably deteriorates the picture quality. The substantially regular arrangement of overlap raster lines and non-overlap raster lines as descrubed in the respective embodiments makes the difference in color between the raster lines recorded in the forward scan and in the backward scan sufficiently inconspicuous.

In order to make the banding more inconspicuous, every raster may be recorded as the overlap raster lines (that is, to be recorded by two nozzles). The process of recording all the raster lines as the overlap raster lines, however, doubles the required time of main scans and thereby halves the recording speed, compared with the process of recording all the raster lines as non-overlap raster lines. In the partial overlap schemes of the above embodiments, however, the overlap raster lines mix with the non-overlap raster lines, and this reduces the decrease in recording speed compared with the full overlap scheme.

In the actual dot recording apparatus, desirable values may be set to the number of used nozzles N, the number of basic nozzles Na, and the number of additional nozzles Nb according to the following procedure. Here it is assumed that the total of 48 nozzles are provided in a nozzle array for each color ink and the nozzle pitch k is equal to 6 dots. The number of used nozzles N is not greater than 48 consequently. Among the possible combinations shown in FIGS. 13(A)–13(C), the combinations where the number of used nozzles N is not greater than 48 can be realized. The greater number of used nozzles N is preferable for the higher printing speed. For example, when L is equal to 1, a preferable combination in FIG. 13(A) is N=48, Na=41, and Nb=7. When L is equal to 2, a preferable combination in FIG. 13(B) is N=47, Na=35, and Nb=12. When L is equal to 3, a preferable combination in FIG. 13(C) is N=47, Na=31, and Nb=16. The desirable value set to the parameter L is determined by actually recording images according to the printing schemes using the respective values of the parameter L and comparing the resulting picture qualities. In this way, the conditions given as Equations (1)–(4) above can determine the desirable values of the number of used nozzles N, the number of basic nozzles Na, and the number of additional nozzles Nb by taking into account the hardware restrictions of the nozzle arrays.

The present invention is not restricted to the above embodiments or their modifications, but there may be many other modifications, changes, and alterations without departing from the scope or spirit of the main characteristics of the present invention. Some possible modifications are given below.

The principle of the present invention is applicable to the single-way printing that records dots in a predetermined main scanning direction (for example, only in the forward scan), as well as the two-way printing.

The present invention is applicable to monochromatic printing as well as color printing. Another possible application is multi-tone printing that divides one pixel into a plurality of dots and thereby expresses multiple tones. Still another application is a drum scan printer. In the drum scan printer, the direction of rotating the drum corresponds to the main scanning direction, and the direction of feeding the carriage corresponds to the sub-scanning direction. The present invention is applicable not only to the ink jet printers but to other dot recording apparatuses which record dots on the surface of a printing medium using a recording head with a plurality of arrays of dot-forming elements. The "dot-forming elements" denotes any elements used for forming dots, such as ink nozzles in the ink jet printer.

Part of the hardware structure in the above embodiments may be implemented by software. Conversely part of the software may be realized by hardware structure. For example, the control functions of the print data controller 13, the carriage driver circuit 5, and the printing medium-feeding controller 9 shown in FIG. 2 may be executed by the computer 90. In this case, the computer programs, such as the printer driver 96, implements the control functions of these circuits.

The computer programs that implement these functions are provided in the form recorded in computer-readable media, such as floppy disks and CD-ROMs. The computer system 90 reads the computer program from the recording medium and transfers the computer program to an internal storage device or an external storage device. In accordance with another application, the computer program may be supplied from a program supply apparatus to the computer system 90 via a communication line. A microprocessor in the computer system 90 executes the computer program stored in the internal storage device to carry out the functions of the computer program. In another example, the computer system 90 may directly execute the computer program recorded on the recording medium.

In the specification hereof, the computer system includes both the hardware structure and the operating system and implies the hardware structure working under the control of the operating system. The computer programs cause the computer system to implement the functions of the respective units. Part of the functions may be implemented by the operating system, instead of by the applications program.

In the present invention, the term "computer-readable medium" include internal storage devices in the computer, such as various RAMs and ROMs, and external storage devices fixed to the computer, such as hard disks, as well as portable recording media, such as flexible disks and CDROMs.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for recording dots on a surface of a printing medium with a dot-recording head, the apparatus comprising:

a dot-forming element array comprising a plurality of dot-forming elements corresponding to a respective plurality of nozzles which are arranged at a substantially constant pitch in a sub-scanning direction on the dot-recording head to face the printing medium and form a plurality of dots of the same color;

a main scanning driver which drives the printing medium to carry out a main scan;

a head driver which activates at least part of the plurality of dot forming elements to form dots in the course of the main scan;

and a sub-scanning driver which drives the printing medium to carry out a sub-scan every time when the main scan is complete;

wherein the sub-scanning driver carries out a sub-scan feed by a constant amount F×P (where P denotes a minimum pitch of dots in the sub scanning direction and F is an integer); and when the pitch of the plurality of dot-forming elements in the sub scanning direction is expressed as k×P (where k is an integer of not less than 3), a number of dot-forming elements N used in one main scan (where N is an integer of not less than 3) and parameters Na, Nb, m, and L satisfy equations (1)–(4):

$$N=Na+Nb \quad (1)$$

$$Na=m\times k\pm 1 \quad (2)$$

$$Nb=Rd(L\times Na\div k) \quad (3)$$

$$F=Na \quad (4)$$

where Na is a number of basic nozzles, Nb a number of additional nozzles, m is an integer of not less than 1, is an integer satisfying a relation of $1\leqq L<k$, and an operator Rd( ) denotes an operation of rounding a decimal fraction in parentheses.

2. An apparatus in accordance with claim 1, wherein the head driver drives the dot-recording head to cause dots recorded by Nb dot-forming elements and dots recorded by Na dot-forming elements to have a complementary positional relationship on each main scanning line.

3. An apparatus in accordance with claim 1, wherein the head driver drives the dot-recording head to cause dots recorded by Nb dot-forming elements to overlap dots recorded by Na dot-forming elements on each main scanning line.

4. An apparatus in accordance with claim 1, wherein the dot-recording head comprises a plurality of the dot-recording element arrays which are used to record dots of plural colors, respectively;

the dot-recording elements in the plurality of dot-recording element arrays are arranged so that the plurality of dot-recording element arrays can record identical main scanning lines during one main scan; and the head driver drives the dot-recording head to record dots in both ways of reciprocating main scan motion.

5. In a method of recording dots on a surface of a printing medium with a dot-recording head during main scanning, the dot-recording head having a dot-forming element array comprising a plurality of dot-forming elements corresponding to a respective plurality of nozzles which are arranged at a substantially constant pitch in a sub scanning direction on the dot-recording head to face the printing medium and form a plurality of dots of the same color, an improvement being in that:

a sub-scan feed is carried out by a constant amount F×P (where P denotes a minimum pitch of dots in the sub-scanning direction and F is an integer); and when the pitch of the plurality of dot-forming elements in the sub scanning direction is expressed as k×P (where k is an integer of not less than 3), a number of dot-forming elements N used in one main scan (where N is an integer of not less than 3) and parameters Na, Nb, m, and L satisfy equations (1)–(4):

$$N=Na+Nb \quad (1)$$

$$Na=m\times k\pm 1 \quad (2)$$

$$Nb=Rd(L\times Na\div k) \quad (3)$$

$$F=Na \quad (4)$$

where Na is a number of basic nozzles, Nb is a number of additional nozzles, m is an integer of not less than 1, is an integer satisfying a relation of $1\leqq L<k$, and an operator Rd( ) denotes an operation of rounding a decimal fraction in parentheses.

6. A method in accordance with claim 5, wherein the dot-recording head is operated to cause dots recorded by Nb dot-forming elements and dots recorded by Na dot-forming elements to have a complementary positional relationship on each main scanning line.

7. A method in accordance with claim 5, wherein the dot-recording head is operated to cause dots recorded by Nb dot-forming elements to overlap dots recorded by Na dot-forming elements on each main scanning line.

8. A method in accordance with claim 5, wherein the dot-recording head comprises a plurality of the dot-recording element arrays which are used to record dots of plural colors, respectively;

the dot-recording elements in the plurality of dot-recording element arrays are arranged so that the plurality of dot-recording element arrays can record identical main scanning lines during one main scan; and the dot-recording head is operated to record dots in both ways of reciprocating main scan motion.

9. A computer program product for a computer controlling a dot cording apparatus for recording dots on a surface of a printing medium with a dot-recording head during main scanning, the dot-recording head having a dot-forming element array comprising a plurality of dot-forming elements corresponding to a respective plurality of nozzles which are arranged at a substantially constant pitch in a sub-scanning direction on the dot-recording head to face the printing medium and form a plurality of dots of the same color, the computer program product comprising:

a computer readable medium; and a computer program stored on the computer readable medium, comprising:

a first program for causing the computer to carry out a sub-scan feed by a constant amount F×P (where P denotes a minimum pitch of dots in the sub-scanning direction and F is an integer); and a second program for causing the computer, when the pitch of the plurality of dot-forming elements in the sub-scanning direction is expressed as k×P (where k is an integer of not less than 3), to making a number of dot forming elements N used in one main scan (where N is an integer of not less than 3) and parameters Na, Nb, m, and L to satisfy equations (1)–(4):

$$N=Na+Nb \quad (1)$$

$$Na=m\times k\pm 1 \quad (2)$$

$$Nb=Rd(L\times Na\div k) \quad (3)$$

$$F=Na \quad (4)$$

where Na is a number of basic nozzles, Nb is a number of additional nozzles, m is an integer of not less than 1, is an integer satisfying a relation of $1\leqq L<k$, and an operator Rd( ) denotes an operation of rounding a decimal fraction parentheses.

* * * * *